US005505309A

United States Patent [19]

Taravella et al.

[11] Patent Number: 5,505,309

[45] Date of Patent: Apr. 9, 1996

[54] ONE-PIECE SHIPPING CONTAINER WITH INTEGRAL DUNNAGE

[75] Inventors: Philip Taravella, Grosse Pointe Shores; Edward J. Blair, New Baltimore; Ronald S. Domanski, St. Clair Shores, all of Mich.

[73] Assignee: Anchor Bay Packaging Corp., St. Clair Shores, Mich.

[21] Appl. No.: 313,475

[22] Filed: Sep. 27, 1994

[51] Int. Cl.[6] ..... B65D 81/05

[52] U.S. Cl. ..... 206/485; 206/589; 493/56

[58] Field of Search ..... 206/45.14, 45.19, 206/449, 453, 454, 485, 562, 589, 509, 521; 229/117.16; 493/56, 69, 79

[56] References Cited

U.S. PATENT DOCUMENTS

| | | | |
|---|---|---|---|
| 2,256,995 | 9/1941 | Andres | 206/589 |
| 2,620,962 | 12/1952 | Powell | 206/485 |
| 3,425,544 | 2/1969 | Ayer | 229/117.1 |
| 4,134,533 | 1/1979 | Heavener | 206/509 |
| 4,485,922 | 12/1984 | Desmond et al. | 206/485 |
| 4,832,199 | 5/1989 | Rigby | 206/485 |
| 5,121,838 | 6/1992 | Dickie | 206/485 |
| 5,263,636 | 11/1993 | Aure | 206/509 |

FOREIGN PATENT DOCUMENTS

| | | | |
|---|---|---|---|
| 576325 | 12/1993 | European Pat. Off. | 206/509 |

*Primary Examiner*—Jimmy G. Foster
*Attorney, Agent, or Firm*—Dykema Gossett

[57] ABSTRACT

A one-piece stackable shipping container with integral dunnage has a bottom, two pairs of opposite side walls, and a pair of cushioning parts. One pair of opposite side walls and the pair of cushioning parts integral therewith are made up by folding a first pair of pieces extending from one pair of opposite edges of the bottom. Another pair of opposite side walls and strips forming flaps to fasten the container are provided by folding a second pair of pieces extending from another pair of opposite edges of the bottom. Folding the first pair of pieces into a geometrical body, as well as fastening the container with the strips imparts the necessary stiffness to the container structure as a whole. Disclosed also is a method of making the container providing die cutting a container integral blank out of a sheet of a foldable material to form the bottom and the two pairs of pieces extending from the two pairs of opposite edges of the bottom and folding these pieces to form the two pairs of opposite side walls and the cushioning parts.

11 Claims, 5 Drawing Sheets

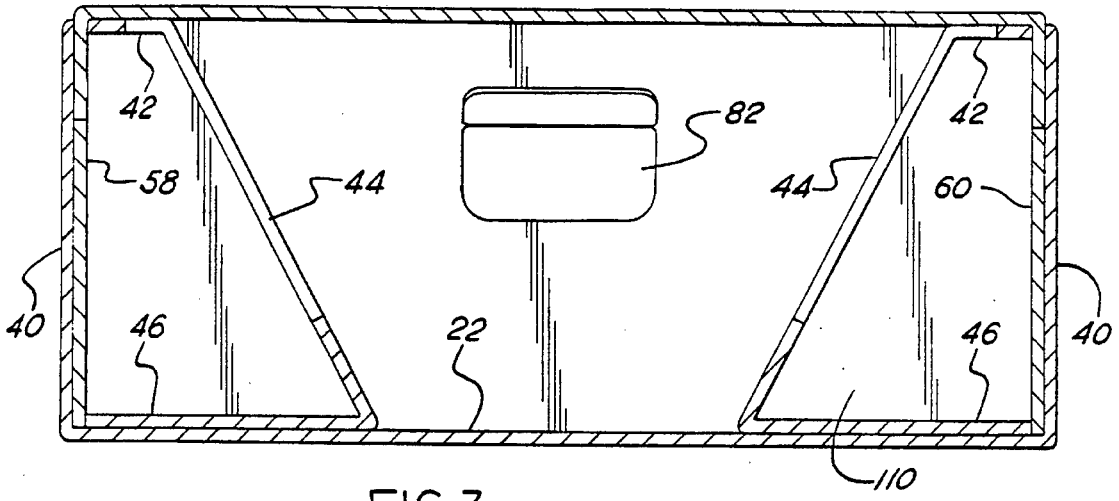
FIG.3
FIG.4
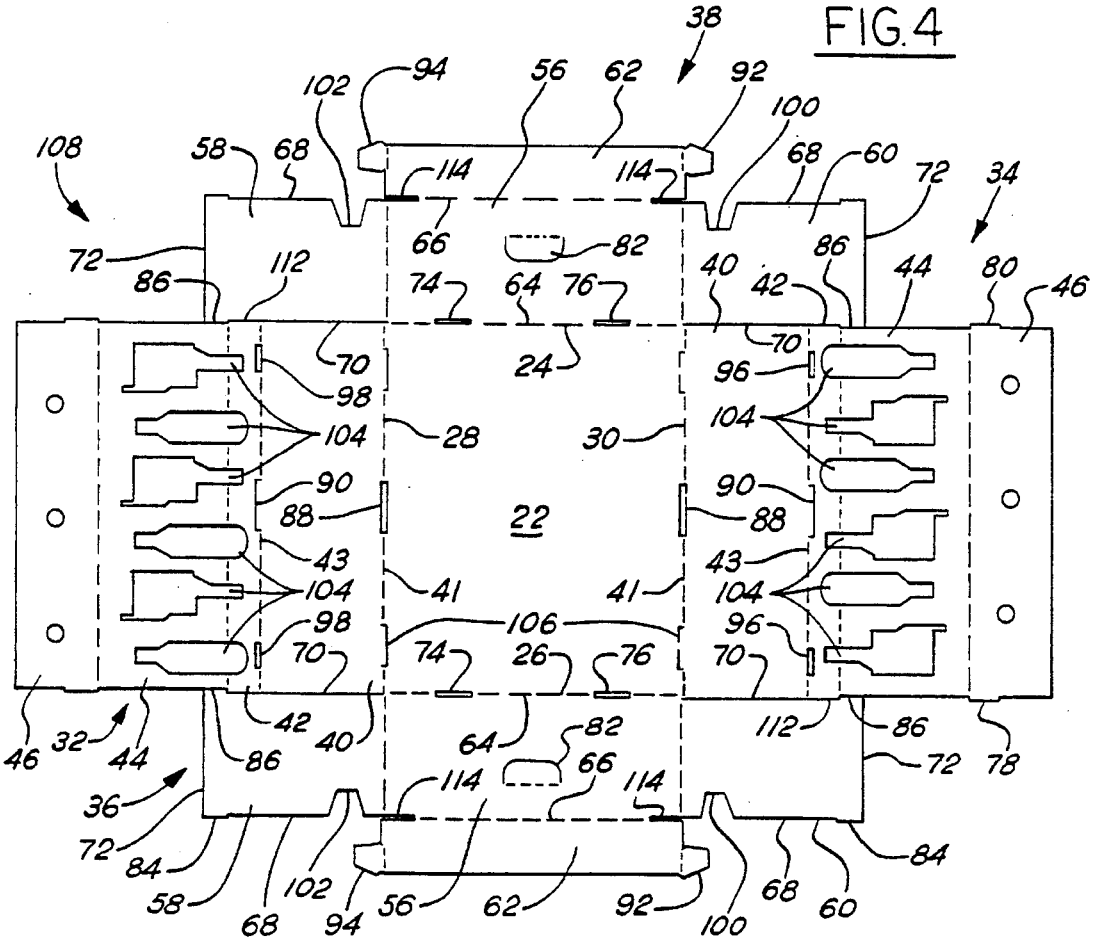

ONE-PIECE SHIPPING CONTAINER WITH INTEGRAL DUNNAGE

BACKGROUND OF THE INVENTION

I. Field of the Invention

This invention relates to packaging techniques and more particularly to shipping containers. Still more particularly, the present invention relates to a one-piece stackable shipping container with integral dunnage.

II. Discussion of the Problem

The packing and shipping of articles, particularly fragile ones, has always presented certain difficulties, including the danger of breaking, scraping, chipping or otherwise damaging the articles. Accordingly, special precautions have been taken to protect them. Materials are used to support and cushion articles being shipped in order to prevent damage. For example, U.S. Pat. No. 2,281,657 discloses a package that protects flat articles against abrasion by firmly holding the articles in the package so that no rubbing takes place. As another example, U.S. Pat. No. 2,005,967 depicts a package in which an article is immobilized by use of corrugated board and filler material. In yet another example, U.S. Pat. No. 3,356,209 shows how foam plastic can be used to immobilize and cushion the article.

In terms of preventing breakage such fillers have been successful, but not without cost in other ways. Often when shipped articles are unpacked and the packaging is discarded, the fillers are thrown out into the environment, producing costs in cleaning up the environment, producing landfills, and operating incineration systems with complex filtration methods for reducing effluent emissions.

There are those skilled in the art who have become particularly aware of environmental concerns, and have reduced the assaults on the environment by recycling dunnage. But recycling causes other problems. One problem is that composite dunnage, such as foam products attached to corrugated fiberboard sheets or plastic products of different chemical makeup, requires that the constituent parts that are not chemically the same to be separated for different recycling treatments. Inasmuch as composite products are usually attached together by use of adhesives or stapling items, such constituent parts are hard to separate as chemically different parts. That is why composite items that are not separable from other recyclable items are often destroyed by methods having the environmental consequences sought to be avoided.

In the light of the above, a need exists in the art for means and methods allowing for the non-trivial disposing of shipping containers and the dunnage therein.

SUMMARY OF THE INVENTION

I. Objects of the Invention

It is therefore an object of the present invention to provide a shipping container with a dunnage, both of them being ecologically safe.

Another object of the invention is to provide a one-piece shipping container.

A further object of the invention is to provide a one-piece shipping container with integral dunnage.

II. Disclosure of the Invention

These and other objects are accomplished by the present invention in which one embodiment of a one-piece stackable shipping container with integral dunnage comprises a bottom, two pairs of side walls, and at least a pair of cushioning parts. The bottom is defined by two pairs of opposite edges and has two pairs of pieces extending beyond respective pairs of the opposite edges. A first one of the two pairs of pieces has one form, and pieces of a second pair have another form. A first one of the two pairs of side walls, being a first pair of opposite side walls, and at least a pair of cushioning parts integral therewith are formed by folding each piece of the first pair of pieces whereas folding each piece of the second pair of the pieces makes up a second pair of side walls being a second pair of opposite side walls. Each piece of the second pair of pieces comprises a strip forming a flap when folded to fasten the container.

The bottom of the container is square or rectangular. There are provided cutouts in the cushioning parts to receive parts intended to be shipped in the container. Cutouts are provided in one of the opposite pair of the side walls reserved for taking and carrying the container.

Top and bottom edges of the side walls of the first pair of the opposite side walls are made with tongues and slots for attaching containers to each other when being stacked.

Each of the pieces of the second pair of pieces is provided with side wings to provide when folded an additional strengthening layer of the first pair of opposite side walls.

Each piece of the first pair of pieces, when folded into a body comprising the side wall of the first pair of opposite side walls and the cushioning part in an assemblage therewith has a geometrical or trapezoidal form in cross-section parallel to the second pair of opposite side walls.

A top surface of the body is made with slots and the side wings are made with notches, whereas the strips are made with tongues to be received into the notches through the top slots.

Edges of a bottom part of the trapezoidal body are provided with tongues and, to receive the body tongues, slots are made in the bottom edges defining the bottom of the container and bordering on the pieces of the second pair of pieces.

A stack of containers is also disclosed as having one-piece shipping containers and a cover placed on the uppermost of the containers. Each of the containers comprises a bottom, side walls, and cushioning parts. The bottom is defined by two pairs of its opposite edges and is provided with two pairs of pieces extending beyond respective pairs of the opposite edges, a first pair of the pieces having one form and a second pair of the pieces having another form. A first pair of the side walls opposite to each other, and the cushioning parts are formed by folding the first pair of the pieces, whereas a second pair of the side walls, also opposite to each other, and an additional layer of the first pair of the side walls are formed by folding the second pair of the pieces. The second pair of the pieces is provided with strips forming flaps fastening the container, and top and bottom edges of the first pair of opposite side walls are made with tongues and slots, to allow the containers to be fastened with each other when being stacked.

In another embodiment of the present invention, a one-piece stackable shipping container with integral dunnage comprises a bottom, two pairs of side walls, and cushioning parts. The bottom of the container is defined by two pairs of its opposite edges and has a first and a second pairs of pieces extending beyond respective pairs of the opposite edges. Each piece of the first and second pairs of pieces comprises a first strip which defines, when folded, a respective side wall of the two pairs of side walls, and a second strip adapted, when folded, to fasten and partially cover the container. The first strip of the first pair of pieces is provided with side flaps with shoulders on its side edges intended to be received into slots made along a line between an edge of the pair of opposite bottom edges and the first strip of the second pair of pieces, whereas the second strip of the second pair of pieces is provided with flaps on its edges intended to be received into slots made along a line between the first and second strips of the first pair of pieces. Each of the cushioning parts is made of a creased part with a fixing lobe forced in an opening made in the creased part. The creased part is formed by means of cutting the same through the bottom of the container and creasing the part so cut. The fixing lobe is made by cutting the same through the bottom adjacent to the creased part. Dimensions of the opening are made less than those of the lobe and the height of the cushioning part does not exceed the height of the walls. The creased part has a triangle form in cross-section.

With these and other objects and advantages in view, the present invention will be clearly understood from the ensuing detailed description in connection with the accompanying drawings.

BRIEF DESCRIPTION OF THE DRAWINGS

FIG. 3 is a cross-sectional view of the container taken generally along the line 3—3 of FIG. 1.

FIG. 4 shows a blank of the container of FIG. 1 ready to be assembled.

DETAILED DESCRIPTION OF THE INVENTION

Figure 1:
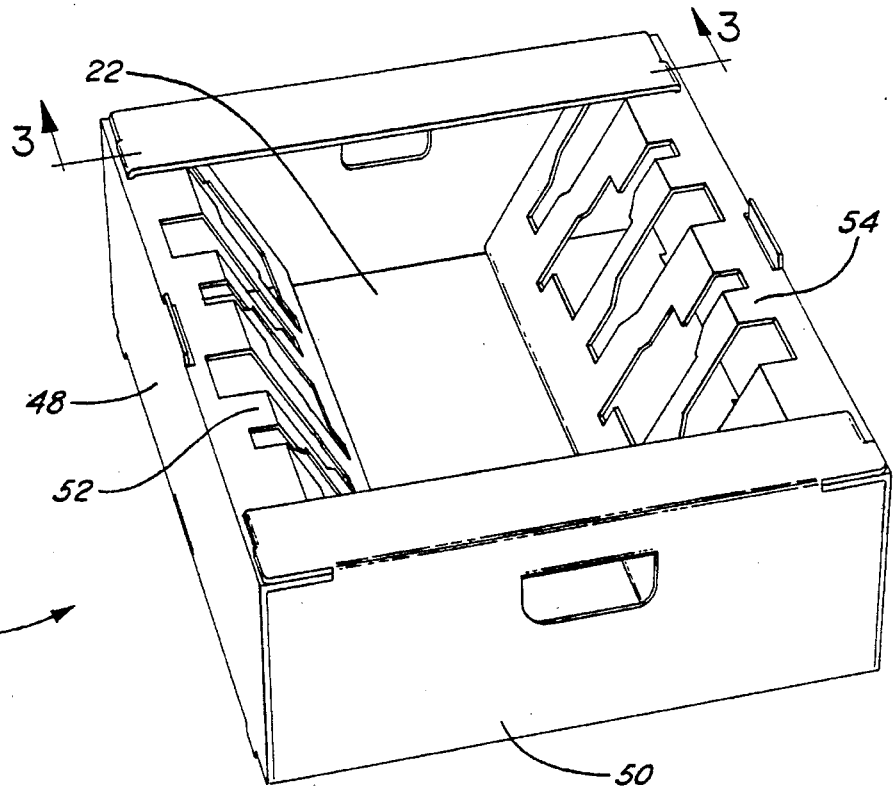
FIG. 1 is a perspective view of an embodiment of the present invention showing a one-piece stackable shipping container with integral dunnage.
Figure 2:
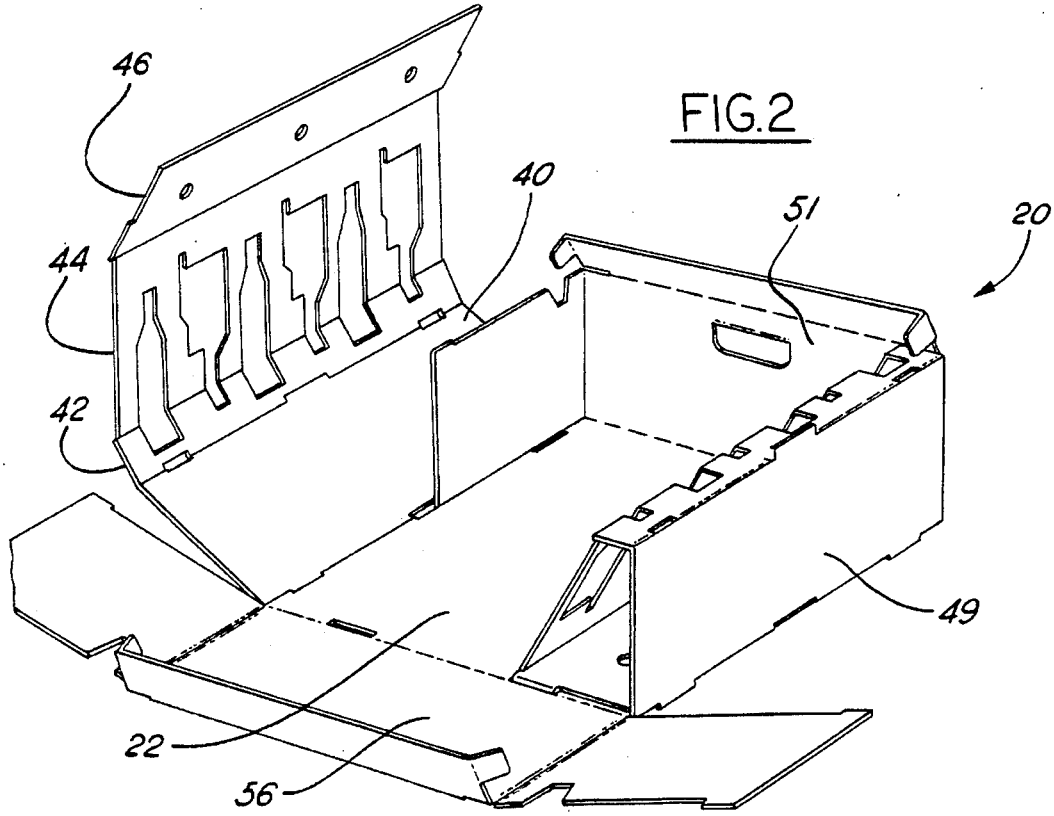
FIG. 2 is a partial perspective view of the embodiment of FIG. 1 showing the container partially assembled and illustrating the process or method of assembling the same.

Referring now to the drawings, and particularly to FIGS. 1, 2, 3, and 4, in which like reference numerals are continued throughout, there is shown a container 20 made of a foldable material, preferably but not exclusively of corrugated board. Container 20 comprises a quadrilateral bottom 22 defined by its edges 24, 26, 28, and 30, beyond which two pairs of pieces 32, 34 and 36, 38 are extended. Borders between edges 24, 26, 28, 30 and pieces 32, 34, 36, 38 are made nicked. Bottom 22 can be of square, rectangular or oblong form.

First pair of pieces 32 and 34 has one form, and each of pieces 32, 34 comprises four oblong bands 40, 42, 44, and 46, respectively, parallel to each other and to edges 28, 30. A first pair 48 and 49 of opposite side walls and a pair 52 and 54 of cushioning parts integral therewith are made up of bands 40–46. For further discussion, a border between bottom 22 and first band 40, coinciding with edge 28 (30), is referred to as a first border 41, whereas a border between first, 40, and second, 42, bands is referred to as a second border 43.

Second pair of pieces 36 and 38 has another form, and each of pieces 36, 38 comprises a central part 56, two identical side wings 58 and 60, and a strip 62. Borders between central part 56, side wings 58, 60, and strip 62 are made nicked. Central part 56 has a central part bottom edge 64 coinciding with edge 24 or 26 of quadrilateral bottom 22, and a central part top edge 66 bordering on strip 62. Each side wing 58, 60 has side wing top 68 and bottom 70 edges and a side edge 72. Central part bottom edge 64 is made with two symmetrical slots 74 and 16 matching opposite tongues 78, 80 formed on side edges of fourth bands 46 of pieces 32, 34. Central part 56 is provided with a cutout 82 equidistant from side wings 58, 60. Cutouts 82 are reserved for taking and carrying container 20.

The height of side wings 58 and 60 equals the width of first band 40, and these side wings make up, when folded, an additional strengthening layer of the first pair of opposite side walls 48, 49. There are tongues 84 and 86 at side wing top 68 and bottom 10 edges. These tongues 84, 86 match slots 88 at first border 41 and slots of tongues 90 at second border 43. There are also tongues 92, 94 at the edges of strip 62 matching slots 96, 98 at second border 43 and notches 100, 102 in side wings 58, 60. Cutouts 104 of different profiles made in second 42 and third 44 bands serve to cushion parts (not shown) which are to be shipped in container 20, whereas tongues 106 made at first border 41 contribute to imparting stability to containers when stacked.

Making the container in accordance with the present invention comprises manufacturing and assembling the container. In the manufacture of the container, a container integral blank 108 shown in FIG. 4 is die cut from a sheet of the foldable material to form quadrilateral bottom 22 and two pairs 32, 34 and 36, 38 of pieces, borders between bottom 22 and pieces 32–38 made nicked. Each one of pieces 32–38 is made to comprise central part 56, side wings 58, 60, and strip 62 with all tongues, slots and cutouts mentioned above for the pair of pieces 36, 38; and to comprise four bands 40–46 with necessary cutouts, tongues and slots described in the above for the pair of pieces 32, 34.

In assembling the container, pieces 36 and 38 are folded, with two central parts 56 forming a pair of opposite side walls 50, 51 of the container, and two pairs of side wings 58 and 60 providing an additional strengthening layer of another pair of container opposite side walls 48, 49. Side wing bottom edge tongues 86 are received in slots 88.

Folding the pieces 32, 34 provides a trapezoidal bodies 110 most clearly shown in cross-section in FIG. 3, with first bands 40 forming side walls 48, 49; second,42, and third, 44, bands forming cushioning parts 52, 54; and fourth bands 46 forming a base for each trapezoidal body 110, tongues 78, 80 of each band 46 being received in respective slots 74, 76. Side wing top edge tongues 84 are received in slots of tongues 90. Edges 112 of second band 42 are received in cutouts 114 made at the edges of the border between central part 56 and strip 62.

Folding strips 62 completes the assembling of the container, with strip side tongues 92, 94 being received through slots 96, 98 at the second border 43 in the side wing notches 100, 102.

Folding the first pair of pieces into the geometrical or trapezoidal body, as well as fastening the container with the strips imparts the necessary stiffness to the container structure as a whole. The easiness with which the container according to the present invention can be assembled furnishes an opportunity to also easily disassemble it when necessary, transport in the "flat" form, and re-use it.

Figure 5:
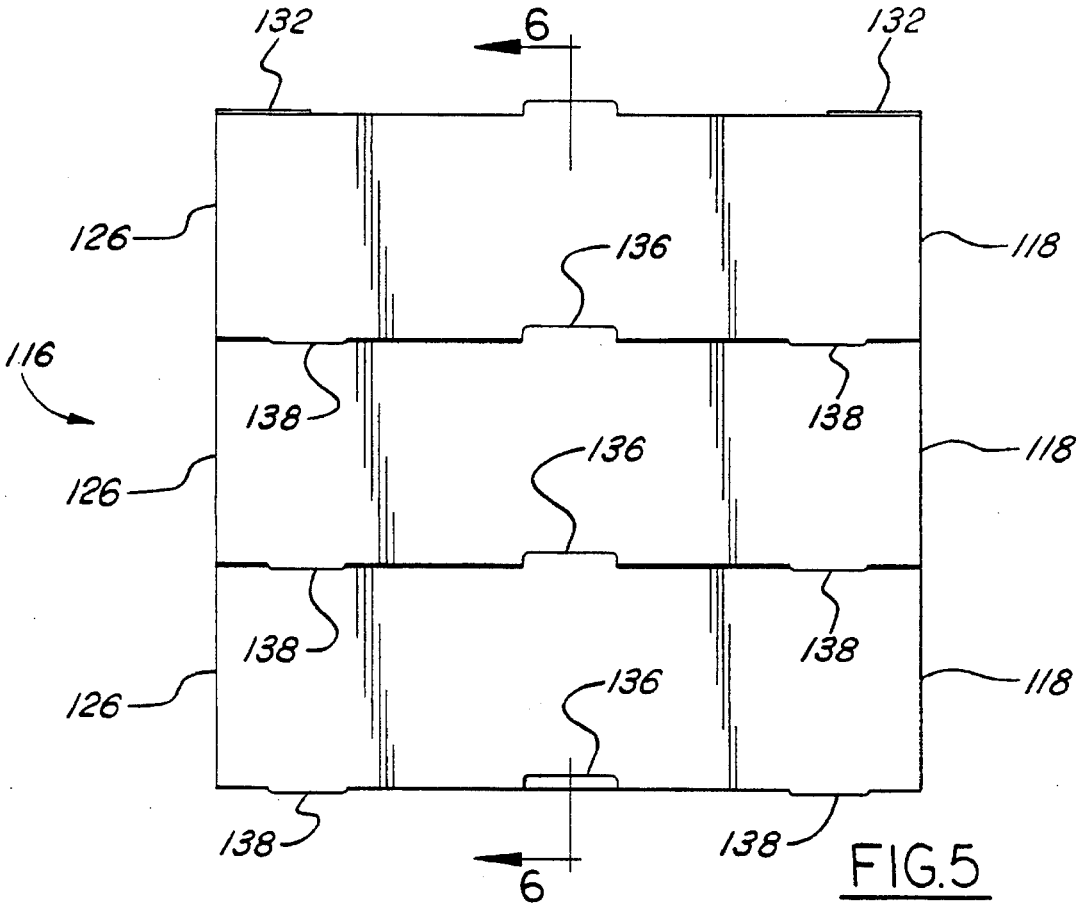
FIG. 5 is a side view of a stack of the containers of FIG. 1.
Figure 6:
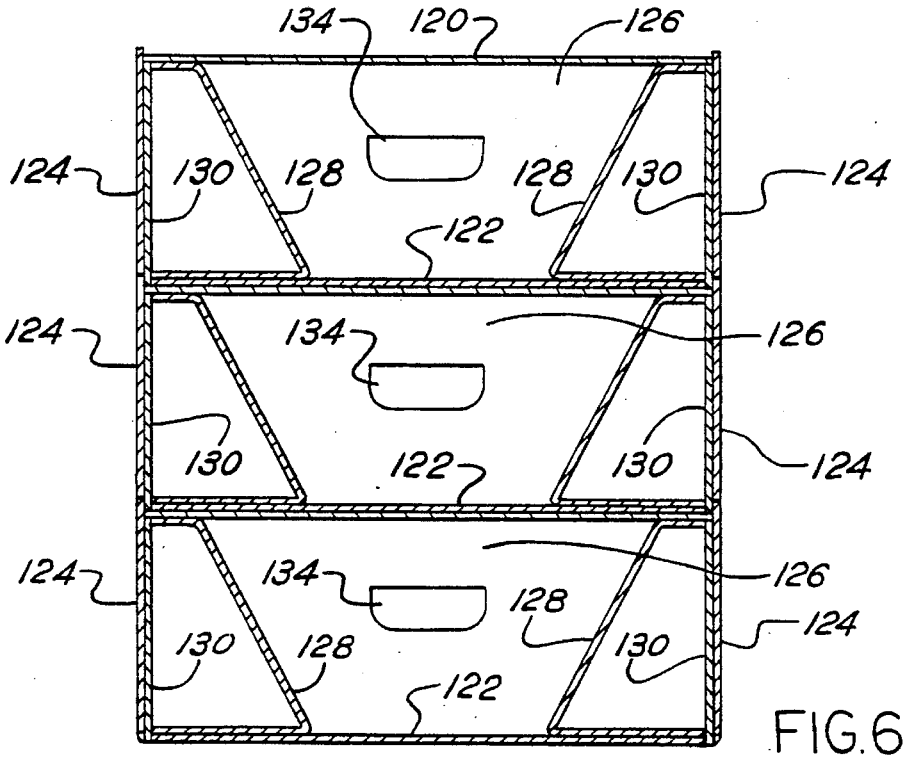
FIG. 6 is a cross-sectional view of the stack taken generally along the line 6—6 of FIG. 5.

Referring now to FIGS. 5 and 6, a stack 116 is shown having three containers 118 of the type described immediately above. The three containers are shown as an example only, and their quantity may differ from three. Stack has a cover 120, and each container 118 comprises a bottom 122, two pairs of opposite side walls 124, 126, and cushioning parts 128. Each of the opposite side walls 124 and cushioning part 128 integral therewith is formed by folding a piece from a first pair of pieces (not shown) extending from one pair of opposite edges of bottom 122, whereas each of the opposite side walls 126 and an additional strengthening layer 130 of side walls 124 is formed by folding a piece from a second pair of pieces (not shown) extending from another pair of opposite edges of bottom 122. Strips 132 constituting a part of the second pair of pieces are used as flaps fastening the container. Cutouts 134 serve for transporting containers. There are also tongues 136 and 138 contributing to the stability of containers 118 in stack 116.

The inventive concept underlying the container described above is also the basis for another embodiment of the present invention shown in FIGS. 7–12. As can be best seen in FIG. 12, a one-piece stackable container 140 with integral dunnage comprises a bottom 142, two pairs of side walls 144, 146 and 148, 150, and cushioning parts 152.

Bottom 142 is provided with two pairs of pieces 154, 156, and 158, 160 extending beyond edges of bottom 142. Each piece comprises a first strip and a second strip. First strips 162, 164, 166, and 168 define, when folded, side walls 144, 146, 148, and 150, correspondingly. Second strips 170, 172, 174, and 176 are intended, when folded, to partially cover and fasten the container. First strips 162 and 164 of the first pair of pieces 154 and 156 are provided with side flaps 178, 180 and 182, 184 having shoulders 186, 188, 190, and 192, respectively. These shoulders 186, 188, 190, and 192 are intended to be received in slots 194, 196, 198, and 200, respectively, made along lines between first strips 166 and 168 of the second pair of pieces 158, 160 and adjacent edges of bottom 142.

Second strips 174, 176 of the second pair of pieces 158, 160 are provided with flaps 202, 204, 206, and 208 on their edges intended to be received in slots 210, 212, 214, and 216 made along lines between the first (162, 164) and the second (170, 172) strips of the first pair of pieces 154, 156.

Figure 9:
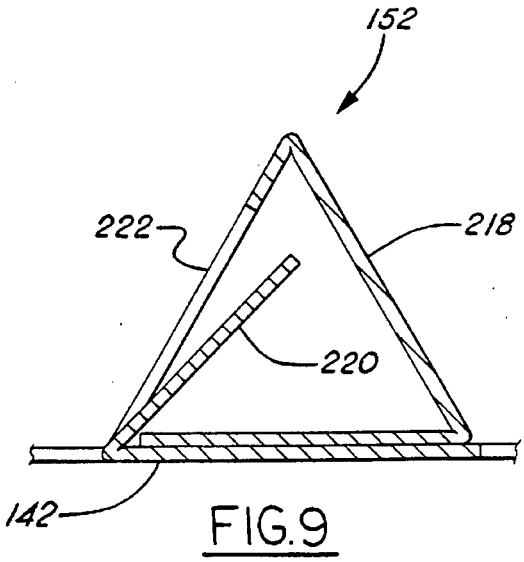
FIG. 9 is a cross-sectional view of the cushioning part of the container shown in FIG. 7 taken generally along the line 9—9 of FIG. 7.
Figure 10:
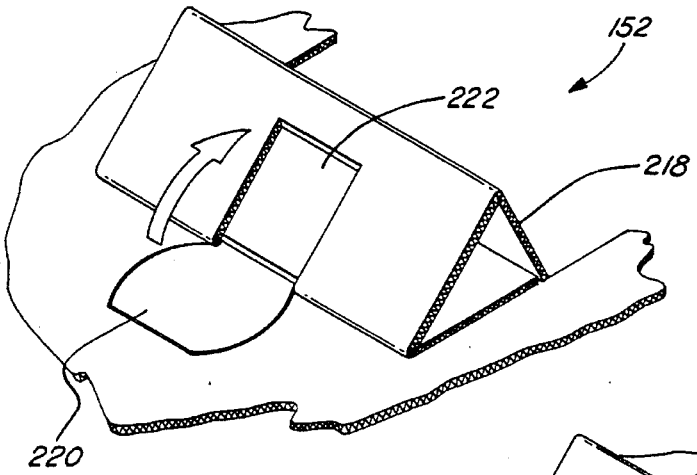
FIGS. 10 and 11 illustrate the cushioning part shown in FIG. 9, with FIG. 10 showing the part before, and FIG. 11 after, it has been fixed.
Figure 11:
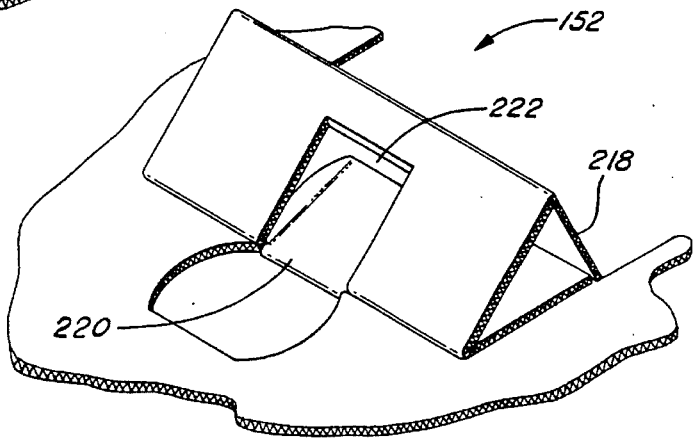
Figure 12:
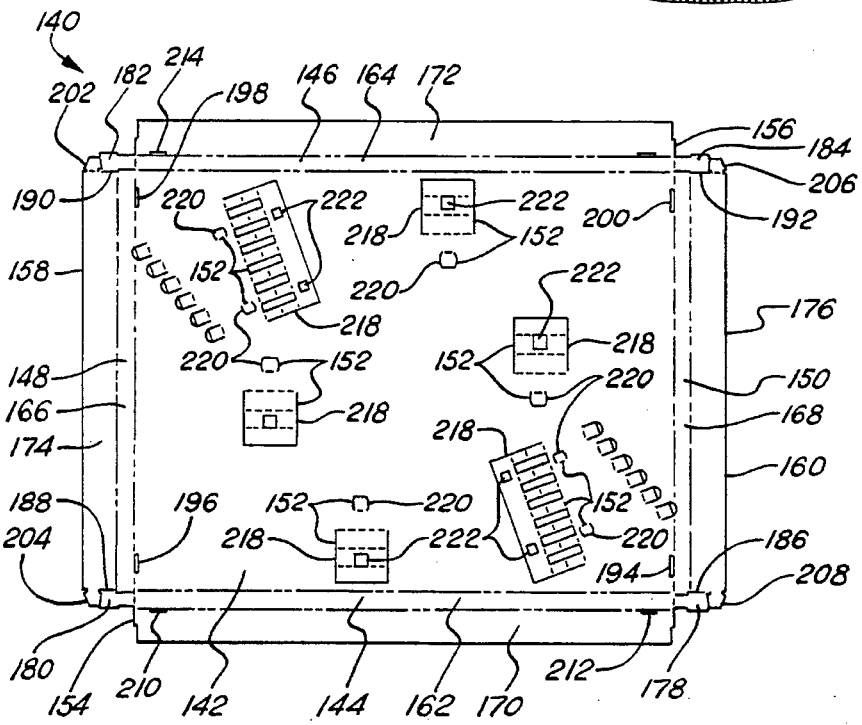
FIG. 12 shows a blank of the container of FIG. 7 ready to be assembled.

Each of the cushioning parts 152, of which an example is separately shown in FIGS. 10, 11, is made of a creased part 218 with a fixing lobe 220 (FIG. 10) intended to be forced into an opening 222 (FIG. 11) made in creased part 218. For that purpose dimensions of opening 222 are made less than those of lobe 220. The creased part is formed by means of cutting the same through bottom 142 and creasing the part so cut. The fixing lobe is made by cutting the same through bottom 142 in the area adjacent to the creased part. The height of the cushioning parts does not exceed the height of the side walls. In their preferred implementation, the creased parts has a triangle form in cross-section (FIG. 9).

Figure 7:
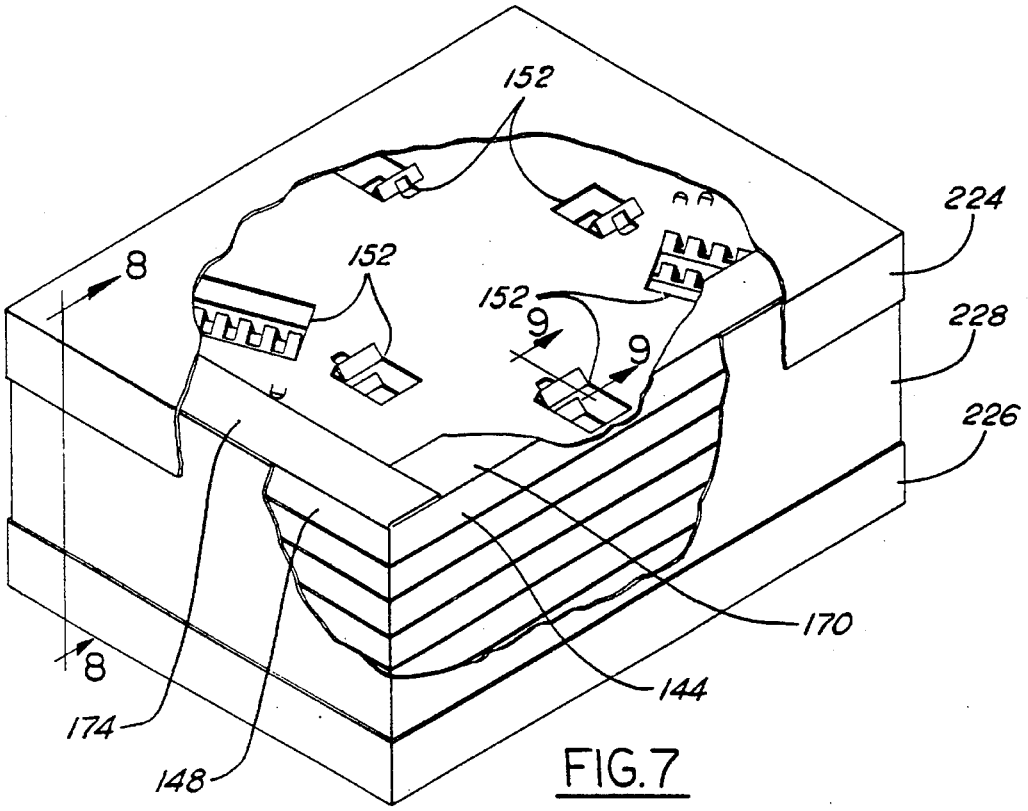
FIG. 7 is a perspective view of a stack of containers of another embodiment of the present invention showing a one-piece stackable shipping container with integral dunnage placed on another container.
Figure 8:
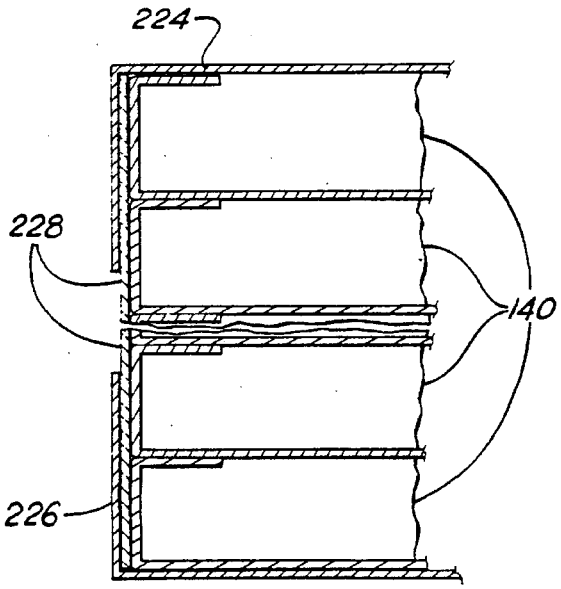
FIG. 8 is a cross-sectional view of the stack of FIG. 7 taken generally along the line 8—8 of FIG. 7.

Containers 140 can be stacked as shown in FIGS. 7 and 8. There are provided a top, 224, and a bottom 226, covers, as well as a side wall 228 enclosing the stack.

A method is disclosed of making a one-piece stackable shipping container with integral dunnage which comprises the steps of:

providing a sheet of a foldable material;

die cutting a container integral blank out of the sheet of the material to form a quadrilateral bottom of the container and two pairs of pieces extending beyond edges of the quadrilateral bottom, borders between the edges and the pieces being made nicked. Each piece of a second pair of the pieces is made having a central part with a bottom edge coinciding with one of the edges of the quadrilateral bottom of the container, two identical side wings, each with top and bottom edges and a side edge, and a strip adjacent to a top edge of the piece. The central part bottom edge is made with two symmetrical slots therein, the central part of the piece is made with a centrally located cutout, each of the wings has a notch in its top edge and symmetrical tongues on distant ends of its top and bottom edges, the strip is provided with symmetrical tongues on its side edges, and symmetrical cutouts are made on edges of a border between the central part and the strip. Each piece of a first pair of the pieces is made having a first, a second, a third, and a fourth successive bands parallel to each other and to a respective edge of the edges of the quadrilateral bottom beyond which the piece is extended. A first border between the quadrilateral bottom and the first band is made with a centrally located slot and two cuts, forming tongues when being folded, on the edges of the first border. A second border between the first band and the second band is made with a centrally located cut, forming a tongue when being folded, and two slots on the edges of the second border. The second and third bands are made with cutouts running therethrough for receiving parts to be shipped in the container. The third and the fourth bands are made symmetrically shorter than the first and second bands, and the fourth band is made with side tongues.

The method further includes the steps of:

folding the central part of the pieces of the second pair of pieces to make up a second pair of opposite side walls;

folding the side wings of the pieces of the second pair of pieces to make up an additional strengthening layer of a first pair of opposite side walls, the side wing bottom edge tongues being received in the first border centrally located slots;

folding the pieces of the first pair of pieces to make up the first pair of opposite side walls and cushioning parts, with the fourth band side tongues being received in the at least two symmetrical central part bottom edge slots, the side wing top edge tongues being received in the second border slots, and edges of the second band being received in the symmetrical cutouts on the edges of the border between the central part and the strip; and folding the strips to fasten the containers with the strip side tongues being received through the second border slots into the side wing notches.

It should be understood that though the shipping container in accordance with the present invention has been described in detail it may be subjected to modifications and other embodiments incorporating the inventive features. Accordingly, it is intended that the foregoing disclosure is to be considered as illustrating the principles of the invention as an example of those features and not as a delimiting descriptions which is the purpose of the claims that follow:

We claim:

1. A one-piece stackable shipping container with integral dunnage comprising:

a bottom, two pairs of side walls, and at least a pair of cushioning parts, said bottom being defined by two pairs of opposite edges thereof and having two pairs of pieces extending beyond respective pairs of said opposite edges, said two pairs of pieces comprising a first pair of said pieces being of one form, and a second pair of said pieces being of another form, said two pairs of side walls comprising a first pair of opposite side walls and a second pair of opposite side walls formed by folding each piece of said first pair of pieces to make up a side wall of said first pair of opposite side walls and a cushioning part of said at least a pair of cushioning parts integral therewith and by golding each piece of said second pair of pieces to make up a side wall of said second pair of opposite side walls, and each said piece of said second pair of pieces comprising a strip adapted when formed to fasten and partially cover said container, each of said pieces of said second pair of pieces being provided with side wings to provide, when folded, an additional strengthening layer of said first pair of opposite side walls, each piece of said first pair of pieces, when folded into a body comprising said side wall of said first pair of opposite side walls in an assemblage with said cushioning part, having a geometrical form in cross-section parallel to said second pair of opposite side walls, and a top surface of each of said body being made with slots, said side wings are made with notches, and said strips are made with tongues received in said notches through said slots.

2. The one-piece shipping container with integral dunnage according to claim 1, wherein said bottom has a square form.

3. The one-piece shipping container with integral dunnage according to claim 1, wherein said bottom has an oblong form.

4. The one-piece shipping container with integral dunnage according to claim 1, wherein each of said cushioning parts is made with cutouts to receive parts intended to be shipped in said container.

5. The one-piece shipping container with integral dunnage according to claim 1, wherein said side walls in one of said opposite pairs of side walls are made with symmetrical cutouts for forming said container.

6. The one-piece shipping container with integral dunnage according to claim 1, wherein top and bottom edges of the side walls of said first pair of opposite side walls are made with tongues and slots, each tongue on one of said edges having a matching slot on another edge.

7. The one-piece shipping container with integral dunnage according to claim 1, wherein edges of a bottom part of said geometrical body are provided with tongues, and respective slots to receive said tongues are made in said edges defining said bottom of said container and bordering on said pieces of said second pair of pieces.

8. A stack comprising one-piece shipping contains, with a cover put on the uppermost of said containers, each of said containers comprising:

a bottom, side walls, and cushioning parts, said bottom being defined by two pairs of opposite edges thereof and being provided with two pairs of pieces extending beyond respective pairs of said opposite edges, said two pairs of pieces comprising a first pair of said pieces being of one form, and a second pair of said pieces being of another form, said two pairs of side walls comprising a first pair of opposite side walls and a second pair of opposite side walls and being formed by folding said first pair of said pieces to form said first pair of side walls and said cushioning parts and by folding said second pair of said pieces to form said first and said second pairs of said side walls, each of said pieces of said second pair of pieces is provided with side wings to provide, when folded, an additional strengthening layer of said first pair of opposite side walls, each piece of said first pair of pieces, when folded into a body comprising said side wall of said first pair of opposite side walls in an assemblage with said cushioning part, having a geometrical form in cross-section parallel to said second pair of opposite side walls, and said second pair of said pieces comprising strips forming flaps when folded to fasten and partially cover said container, a top surface of each said body being made with slots, said side wings are made with notches and said strips are made with tongues received in said notches through said slots, and top and bottom edges of said first pair of opposite said walls being made with tongues and slots, to allow said containers to be fastened with each other when being stacked.

9. A method of making a one-piece stackable shipping container with integral dunnage comprising the steps of:

providing a sheet of a foldable material, die cutting a container integral blank out of said sheet of said material, to form:

a quadrilateral bottom of said container and two pairs of pieces extending beyond edges of said quadrilateral bottom, borders between said edges and said pieces being made nicked, each piece of a second of said two pairs being made having a central part with a bottom edge thereof coinciding with one of said edges of said quadrilateral bottom of said container said bottom, two identical side wings, each with top and bottom edges and a side edge, and a strip adjacent to a top edge of said piece, said central part bottom edge being made with two slots therein, said central part being made with a centrally located cutout, each of said wings having a notch in said top edge thereof and tongues on distant ends of said top and bottom edges, said strip having symmetrical tongues on side edges thereof, and symmetrical cutouts being made on edges of a border between said central part and said strip, each piece of a first of said two pairs being made having a first, a second, a third, and a fourth successive bands parallel to each other and to a respective edge of said edges of said quadrilateral bottom beyond which said piece is extended, a first border between said quadrilateral bottom and said first band being made with a centrally located slot and two cuts, forming tongues when being folded, on the edges of said first border, a second border between said first band and said second band being made with a centrally located cut, forming a tongue when folded, and two slots on the edges of said second border, said second and said third bands being made with cutouts running therethrough for receiving parts to be shipped in said container, said third and said fourth bands being made shorter than said first and second bands, and said fourth band being made with side tongues, folding said central part of said pieces of said second pair of pieces to provide a second pair of opposite side walls, folding said side wings of said pieces of said second pair of pieces to provide an additional strengthening layer of a first pair of opposite side walls, said side wing bottom edge tongues being received in said first border centrally located slots, folding said pieces of said first pair of pieces to provide said first pair of opposite side walls and cushioning parts, with said fourth band side tongues being received in said central part bottom edge slots, said side wing top edge tongues being received in said second border slots, and edges of said second band being received in said cutouts on said edges of said border between said central part and said strip, and folding said strips to fasten said container, with said strip side tongues being received through said second border slots into said side wing notches.

10. A one-piece stackable shipping container with integral dunnage comprising:

a bottom, two pairs of side walls, and cushioning parts, said bottom being defined by two pairs of opposite edges thereof and having a first and a second pairs of pieces extending beyond respective pairs of said opposite edges, each piece of said first and said second pairs of pieces comprising a first strip defining, when folded, a respective side wall of said two pairs of side walls, and a second strip adapted when folded to fasten and partially cover said container, said first strip of said first pair of pieces being provided with side flaps with shoulders on side edges thereof to be received into slots being made along a line between an edge of said pair of opposite bottom edges and said first strip of said second pair of pieces, said second strip of said second pair of pieces being provided with flaps on edges thereof to be received into slots being made along a line between said first and said second strips of said first pair of pieces, each of said cushioning parts being made of a creased part with a fixing lobe forced in an opening made in said creased part, said creased part being formed by means of cutting the same through said bottom and creasing said cut part, and said fixing lobe being made by cutting the same through said bottom adjacent to said creased part, dimensions of said opening being less than those of said lobe and the height of said cushioning part not exceeding the height of said walls.

11. The one-piece shipping container with integral dunnage according to claim 10, wherein said creased part has a triangle form in cross-section.

* * * * *